US009482402B2

(12) United States Patent
Fukawa et al.

(10) Patent No.: US 9,482,402 B2
(45) Date of Patent: Nov. 1, 2016

(54) AUTOMOTIVE LAMP

(75) Inventors: Noriko Fukawa, Shizuoka (JP); Masashi Omote, Shizuoka (JP); Mamoru Kosuge, Shizuoka (JP); Yuji Saito, Aichi (JP); Hirohisa Kato, Aichi (JP); Takehiro Shimizu, Aichi (JP); Norihito Soma, Aichi (JP)

(73) Assignees: KOITO MANUFACTURING CO., LTD., Minato-Ku, Tokyo (JP); ITOH OPTICAL INDUSTRIAL CO., LTD., Gamagori, Aichi-pref. (JP)

( * ) Notice: Subject to any disclaimer, the term of this patent is extended or adjusted under 35 U.S.C. 154(b) by 198 days.

(21) Appl. No.: 13/490,185

(22) Filed: Jun. 6, 2012

(65) Prior Publication Data

US 2012/0314441 A1 Dec. 13, 2012

(30) Foreign Application Priority Data

Jun. 7, 2011 (JP) ..... 2011-127486

(51) Int. Cl.
*F21S 8/10* (2006.01)

(52) U.S. Cl.
CPC ..... *F21S 48/1159* (2013.01); *F21S 48/1258* (2013.01)

(58) Field of Classification Search
CPC ..... G02B 27/48; G02B 27/1026; G02B 27/0961; G03B 21/2013; G03B 21/206; G03B 21/602; H04N 9/3155; H04N 9/3161; H04N 9/3164; F21S 48/125; F21S 48/1258; F21S 48/1317; F21S 48/1159; F21V 13/08; G01N 21/47; G01N 21/55
USPC ..... 362/358, 335, 347; 348/335, 744, 756; 216/26
See application file for complete search history.

(56) References Cited

U.S. PATENT DOCUMENTS

2004/0263979 A1 12/2004 Kimura
2008/0253141 A1* 10/2008 Nakada et al. ..... 362/507
2010/0135036 A1 6/2010 Matsuba et al.

FOREIGN PATENT DOCUMENTS

CN 101046280 A 10/2007
CN 101285561 A 10/2008
JP 2003-185955 A 7/2003
JP 2004-205990 A 7/2004
JP 2005-302718 A 10/2005

(Continued)

OTHER PUBLICATIONS

Chinese First Office Action dated Feb. 8, 2014 issued in the corresponding Chinese Patent Application No. 2012101866801 and English language translation.

(Continued)

*Primary Examiner* — Stephen F Husar
*Assistant Examiner* — Danielle Allen
(74) *Attorney, Agent, or Firm* — Buchanan Ingersoll & Rooney PC

(57) ABSTRACT

An automotive lamp includes an LED, a substrate that mounts the LED, a reflector that reflects the light emitted from the LED, and an projection lens having an incident surface, which receives the light reflected by the reflector, and an emission surface that emits the light toward a front area of the automotive lamp. A fine asperity structure is formed on the incident surface of the projection lens. The fine asperity structure includes recesses or raised portions formed with the pitch less than or equal to the visible light wavelength.

7 Claims, 7 Drawing Sheets

(56) References Cited

FOREIGN PATENT DOCUMENTS

| | | |
|---|---|---|
| JP | 2007-035547 | 8/2007 |
| JP | 2010-212021 A | 9/2010 |

OTHER PUBLICATIONS

Chinese Rejection Decision dated Sep. 23, 2014 issued in the corresponding Chinese Patent Application No. 2012101866801 and English language translation.

Office Action (Notification of Reexamination) issued on May 29, 2015, by the Chinese Patent Office in corresponding Chinese Patent Application No. 2012101866801, and an English Translation of the Office Action (11 pages).

Office Action (Notification of Reason(s) for Refusal) issued on Feb. 3, 2015, by the Japanese Patent Office in corresponding Japanese Patent Application No. 2011-127486, and an English Translation of the Office Action. (7 pages).

* cited by examiner

AUTOMOTIVE LAMP

CROSS-REFERENCES TO RELATED APPLICATIONS

This application claims priority from Japanese Application No. 2011-127486, filed on Jun. 7, 2011.

BACKGROUND OF THE INVENTION

1. Field of the Invention

The present invention relates to an automotive lamp and, more particularly, to a projector-type automotive lamp using a projection lamp.

2. Description of the Related Art

In general, a projector-type automotive lamp is configured such that a projection lens is disposed on a light axis extending in frontward and rearward directions of a vehicle and such that a light source is disposed on a rear side of rear focal point of the projection lens. Thus, the projector-type automotive lamp is generally configured such that the light emitted from the light source is reflected by a reflector toward the projection lens. Where the light distribution pattern for low beam is to be formed by the projector-type automotive lamp, a shade for blocking a part of light from the reflector is arranged in the vicinity of the rear focal point of the projection lens so that an upper edge of the shade can be positioned near the light axis. Thereby, a predetermined cutoff line is formed at an upper edge of the low-beam light distribution pattern (See Japanese Patent Application Publication No. 2007-35547, for instance).

When light from the reflector enters the projection lens in such a projector-type automotive lamp, light partially reflects on the incident surface of the projection lens. The reflection on the incident surface of the projection lens causes degradation in the light utilization efficiency.

SUMMARY OF THE INVENTION

The present invention has been made in view of the foregoing circumstances, and a purpose thereof is to provide a technology capable of improving the light utilization efficiency in an automotive lamp using a projection lens.

To resolve the foregoing problems, an automotive lamp according to one embodiment of the present invention includes: a light source mounting part configured to mount a light source thereon; and a projection lens having an incident surface, which receives light emitted from the light source, and an emission surface that emits the light toward a front area of the automotive lamp. A fine asperity structure is formed on at least one of the incident surface and the emission surface of the projection lens.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which.

DETAILED DESCRIPTION OF THE INVENTION

The invention will now be described by reference to the preferred embodiments. This does not intend to limit the scope of the present invention, but to exemplify the invention.

Hereinbelow, a detailed description will be given of automotive lamps according to exemplary embodiments with reference to the drawings.

Figure 1:
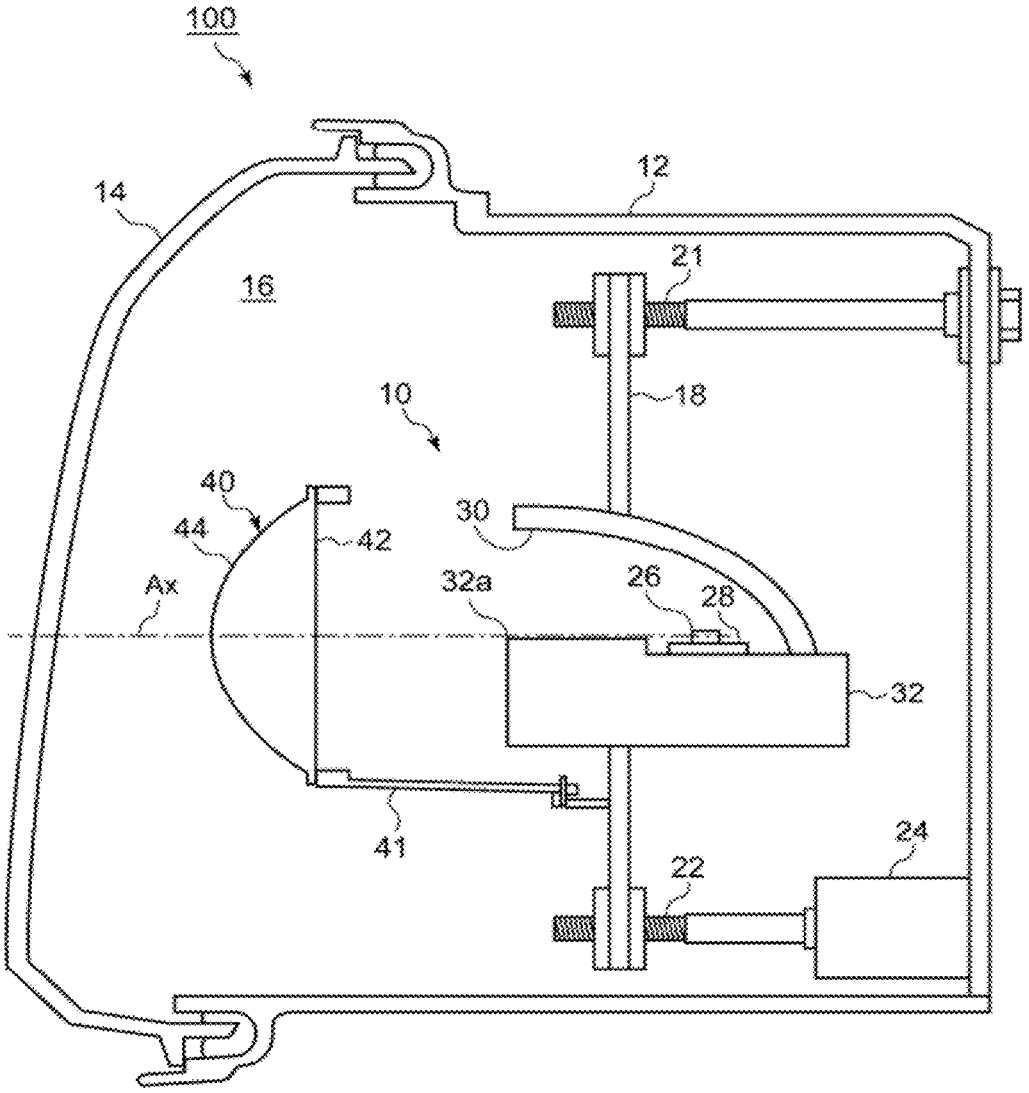
FIG. 1 is a cross-sectional view of an automotive lamp according to an exemplary embodiment of the present invention.

FIG. 1 is a cross-sectional view of an automotive lamp 100 according to an exemplary embodiment of the present invention. The automotive lamp 100 is a projector-type automotive lamp unit and has a function of emitting low beams toward a front area of a vehicle.

As shown in FIG. 1, the automotive lamp 100 includes a lamp body 12 having a recess that is opened toward a front part of the lamp, and a cover 14 for blocking the opening surface of the lamp body 12. In this automotive lamp 100, an internal space formed by the lamp body 12 and the cover 14 is formed as a lamp chamber 16.

A lamp unit 10 is placed within the lamp chamber 16. As shown in FIG. 1, the lamp unit 10 is mounted in an approximately central part of a bracket 18. A first aiming screw 21 is mounted on an upper portion of the bracket 18, whereas a second aiming screw 22 is mounted on a lower portion of the bracket 18. The bracket 18 is supported by the first aiming screw 21 and the second aiming screw 22 attached to the lamp body 12 in a freely tiltable manner. The lower second aiming screw 22 is provided with an aiming actuator 24. As the aiming actuator 24 is driven, the bracket 18 is tilted, which causes the tilting of the lamp unit 10 accordingly. Thereby, the light axis of the illuminating light is adjusted (i.e., an aiming adjustment is done).

The lamp unit 10 includes an LED 26 as a light source, a substrate 28 as a light source mounting part, a reflector 30 that reflects light emitted from the LED 26 in the frontward direction of the lamp, a substrate support member 32 that supports the substrate 28, a projection lens 40, and a lens support member 41.

The LED 26 is a white-color light emitting diode having a light emitting part (light emitting chip) of an appropriately square shape with the side length of about 1 mm. Also, the LED 26 is placed on the substrate 28 such that the light emission surface of the LED faces upward. The substrate 28 not only firmly holds the LED 26 but also supplies current to the LED 26.

The reflector 30 is formed such that the reflector 30 has a shape of an elliptical sphere in a vertical cross section and a shape of an ellipse-based free curved surface in a horizontal cross section. The reflector 30 is placed such that a first focal point thereof is in the vicinity of the LED 26 and a second focal point thereof is in the vicinity of an end 32*a* of the substrate support member 32. The end 32*a* of the substrate support member 32 is configured such that the light reflected from the reflector 30 is so selectively cut as to form oblique cutoff lines in a light distribution pattern projected toward a front area of the vehicle. In other words, the end 32*a* of the substrate support member 32 functions as a shade for blocking a part of light from the reflector 30.

The projection lens 40 has an incident surface 42, which receives the light that has first emitted from the LED 26 and then has reflected by the reflector 30, and an emission surface 44 that emits the light toward a front area of the lamp. The projection lens 40 is a plano-convex aspheric lens wherein the incident surface 42 of the projection lens 40 is formed with a plane surface and the emission surface 44 thereof is formed with a convex surface. The projection lens 40, which is supported by the lens support member 41, is provided in front of the reflector 30. A light axis Ax of the projection lens 40 is approximately parallel to the frontward and rearward directions of the vehicle. A rear-side focal point of the projection lens 40 is nearly identical to the second focal point of the reflector 30. The projection lens 40 projects a light source image formed on a rear-side focal plane toward a front area of the automotive lamp 100 as a reverted image.

Figure 2B:
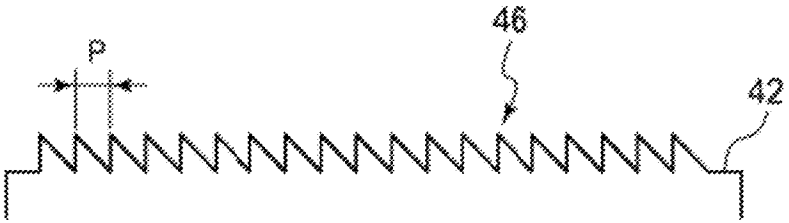
FIGS. 2A and 2B are diagrams for explaining a projection lens according to an exemplary embodiment.
Figure 2A:
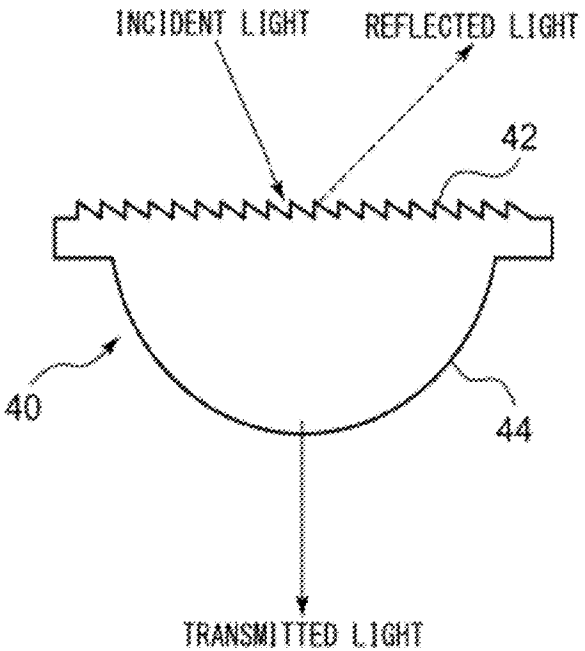

FIGS. 2A and 2B are diagrams for explaining a projection lens according to the present exemplary embodiment. FIG. 2A is an overall view of the projection lens. As shown in FIG. 2A, a part of the light incident on the projection lens 40 becomes the reflected light, and the remaining light becomes the transmitted light that emits from the emission surface 44. Reduction in the reflected light that reflects by the incident surface 42 results in an increase in the transmitted light that emits from the emission surface 44, so that the light utilization efficiency can be improved.

FIG. 2B is an enlarged view of the incident surface of the projection lens. In the present exemplary embodiment, as shown in FIG. 2B, a structure with fine asperities is formed in the incident surface 42 of the projection lens 40. This fine asperity structure 46 is a nano-structured surface pattern including recesses or raised portions. This pattern is formed such that a pitch P between the adjacent recesses or between the adjacent raised portions is less than or equal to a visible light wavelength (380 nm to 780 nm).

Figure 3A:
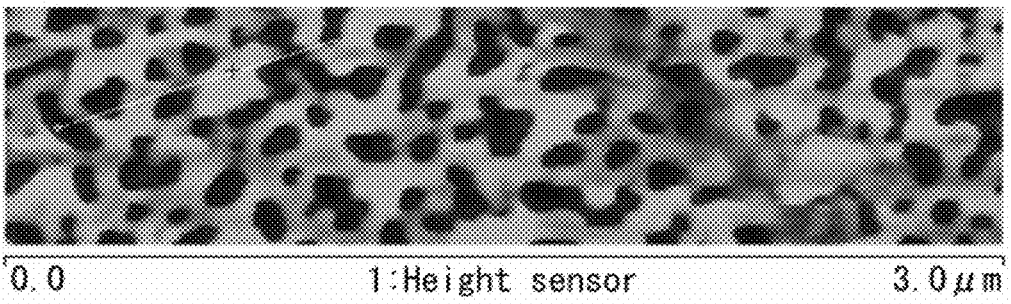
FIGS. 3A and 3B are atom force microscope (AFT) images of a fine asperity structure produced experimentally as a prototype.
Figure 3B:
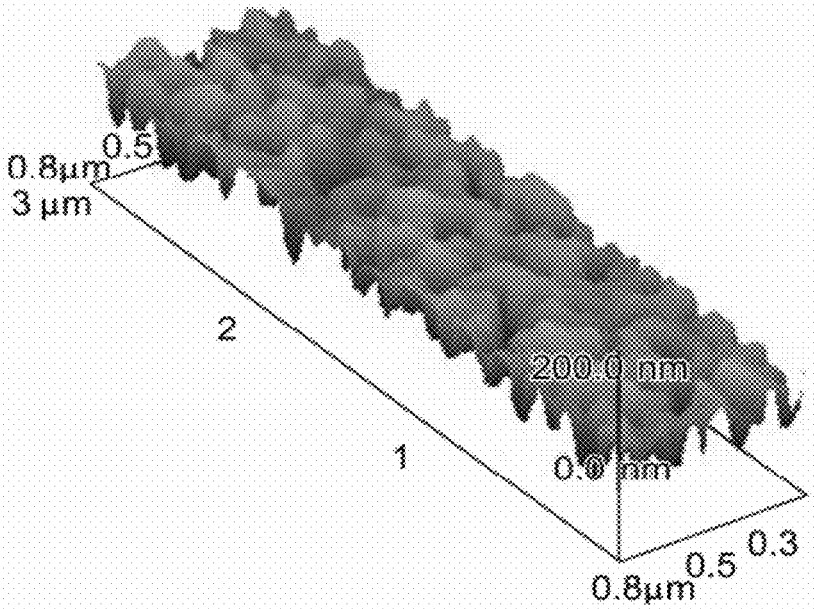

FIGS. 3A and 3B are atom force microscope (AFT) images of a fine asperity structure produced experimentally as a prototype. FIG. 3A is an AFM image of the fine asperity structure viewed from top, whereas FIG. 3B is an AFT image thereof as viewed perspectively.

The pitch P between adjacent recesses or the pitch between adjacent raised portions is constant in FIG. 2B. As shown in FIGS. 3A and 3B, however, the recesses or raised portions having various pitches P therebetween may be randomly present on the incident surface 42. More specifically, it is only necessary that the fine asperity structure 46 shall include the recesses or raised portions whose pitch P is less than or equal to the visible light wavelength. There may also be recesses or raised portions whose pitch is larger than the pitch P which is less than or equal to the visible wavelength. For example, the fine asperity structure 46 may be composed of recesses or raised portions whose pitch ranges from 10 nm to 1000 nm. Also, it is preferable that the aspect ratio of each recess or raised portion in the fine asperity structure 46 is 1 or above. Here, the aspect ratio is a value obtained when the height of each recess or raised portion is divided by the width thereof.

When light enters from air to a material whose index of refraction is greater than that of air, a part of the light normally reflects on the boundary between air and the material. If, however, the fine asperity structure 46 as described above is formed on the incident surface 42, light will be less likely to recognize the boundary and therefore the reflected light will be reduced and the transmitted light will increase. Thus, the use of the projection lens 40 where the fine asperity structure 46 is formed on the incident surface 42 achieves the automotive lamp 100 having an improved light utilization efficiency.

Resin, such as acrylic or polycarbonate, which is transparent to the visible light may be used for the material of the projection lens 40. If the projection lens 40 is to be injection molded, the fine asperity structure 46 can be formed by the use of a metallic mold where a nano-order fine asperity structure is formed on the surface. The method of forming the fine asperity structure 46 is not limited to the above and, for example, the fine asperity structure 46 may be formed on the incident surface 42 by using a method such as etching.

Figure 4:
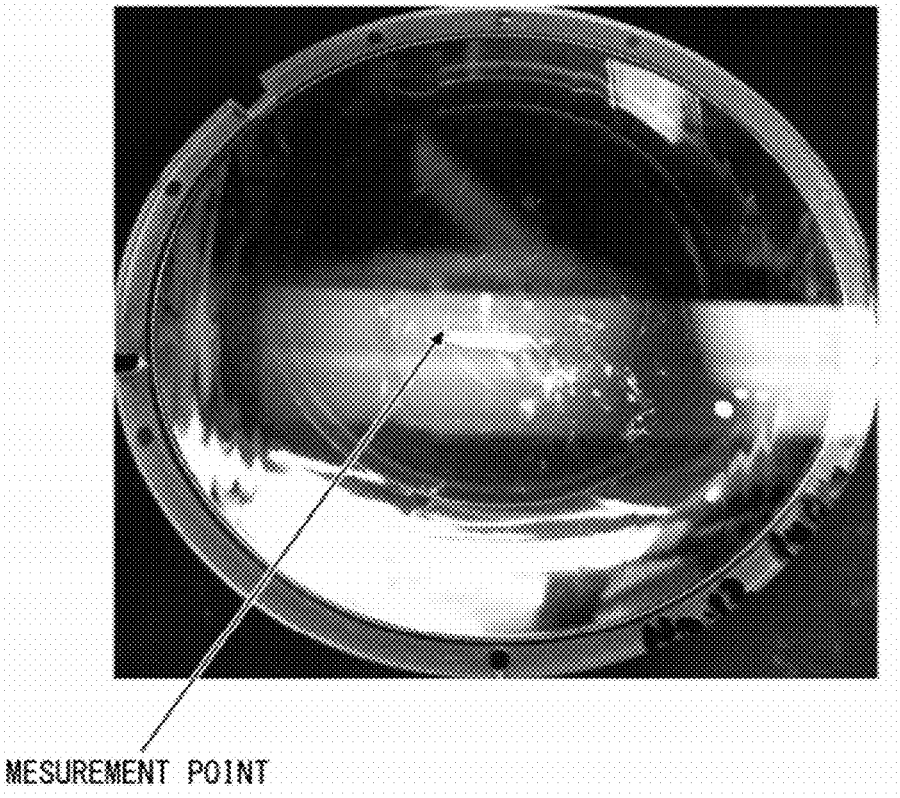
FIG. 4 is a photograph of a projection lens, according to an exemplary embodiment, as viewed from an incident surface side.

A description is now given of a projection lens which is a prototype built by the inventors of the present invention. FIG. 4 is a photograph of the prototype projection lens, according to an exemplary embodiment, as viewed from an incident surface side. The arrow in FIG. 4 indicates the measurement point of the reflectance on the incident surface. Here, the reflectance is measured using a spectrometer. The projection lens, which is made of acrylic, is formed by injection molding. For the projection lens, formed are recesses or raised portions whose pitch ranges from 10 nm to 1000 nm and whose aspect ratio is 1 or above.

Figure 5:
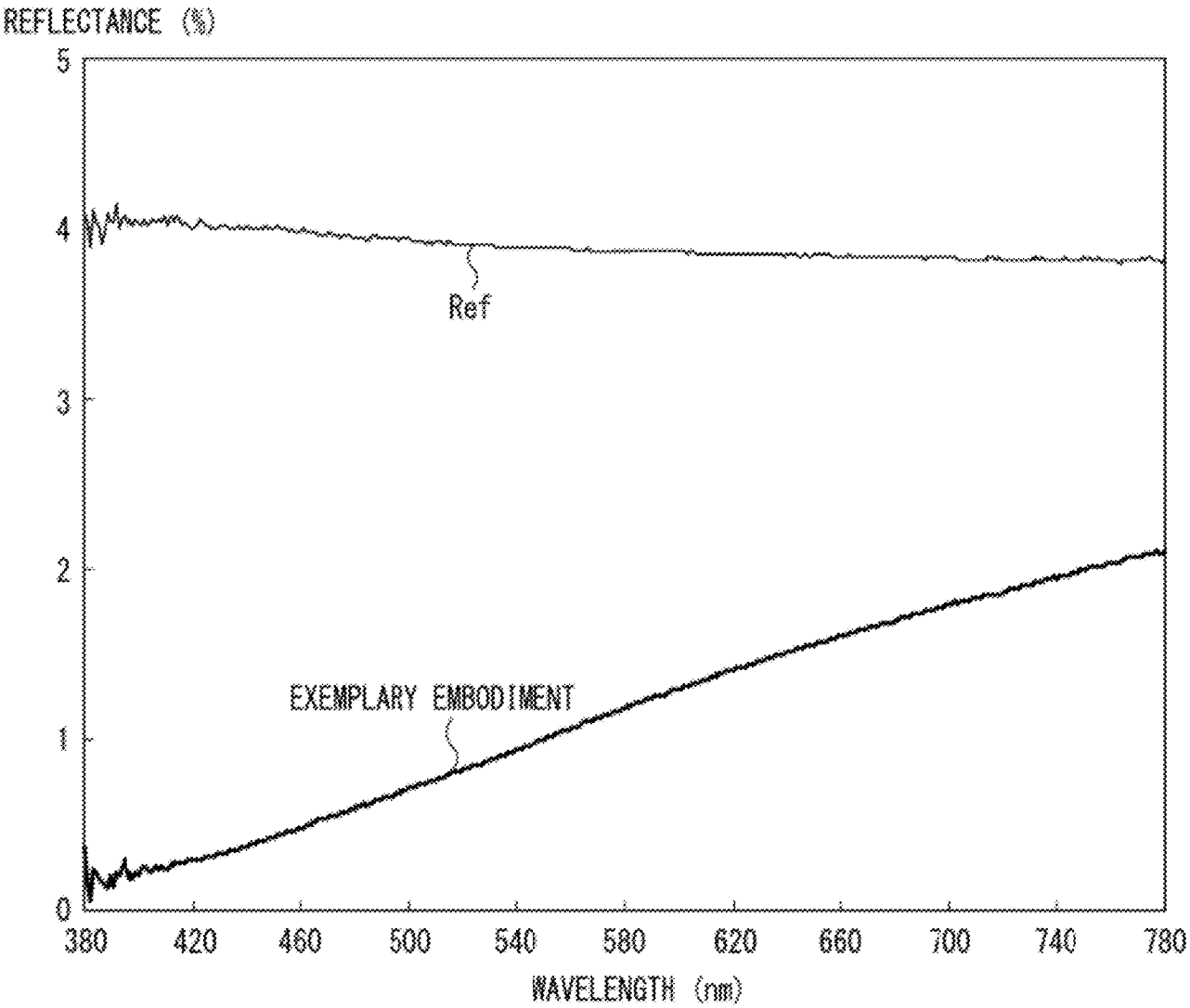
FIG. 5 is a graph showing reflectance characteristics of a projection lens on an incidence surface according to an exemplary embodiment.

FIG. 5 is a graph showing reflectance characteristics of the projection lens on the incidence surface according to the present exemplary embodiment. In FIG. 5, the vertical axis represents the reflectance (%), and the horizontal axis represents the wavelength (nm). In addition to the reflectance characteristics of the projection lens according to the present exemplary embodiment, FIG. 5 depicts the reflectance characteristics of a projection lens as a comparative example (denoted "Ref" in the graph) where no fine asperity structure is formed.

As evident from FIG. 5, the reflectance of the projection lens where no fine asperity structure is formed is about 4% over the entire visible light wavelength range of 380 nm to 780 nm. In contrast thereto, the reflectance of the projection lens according to the present exemplary embodiment is 2.5% or less over the entire visible light wavelength range. Thus, the formation of the fine asperity structure on the incident surface of the projection lens significantly reduces the reflectance at the incident surface.

Figure 6:
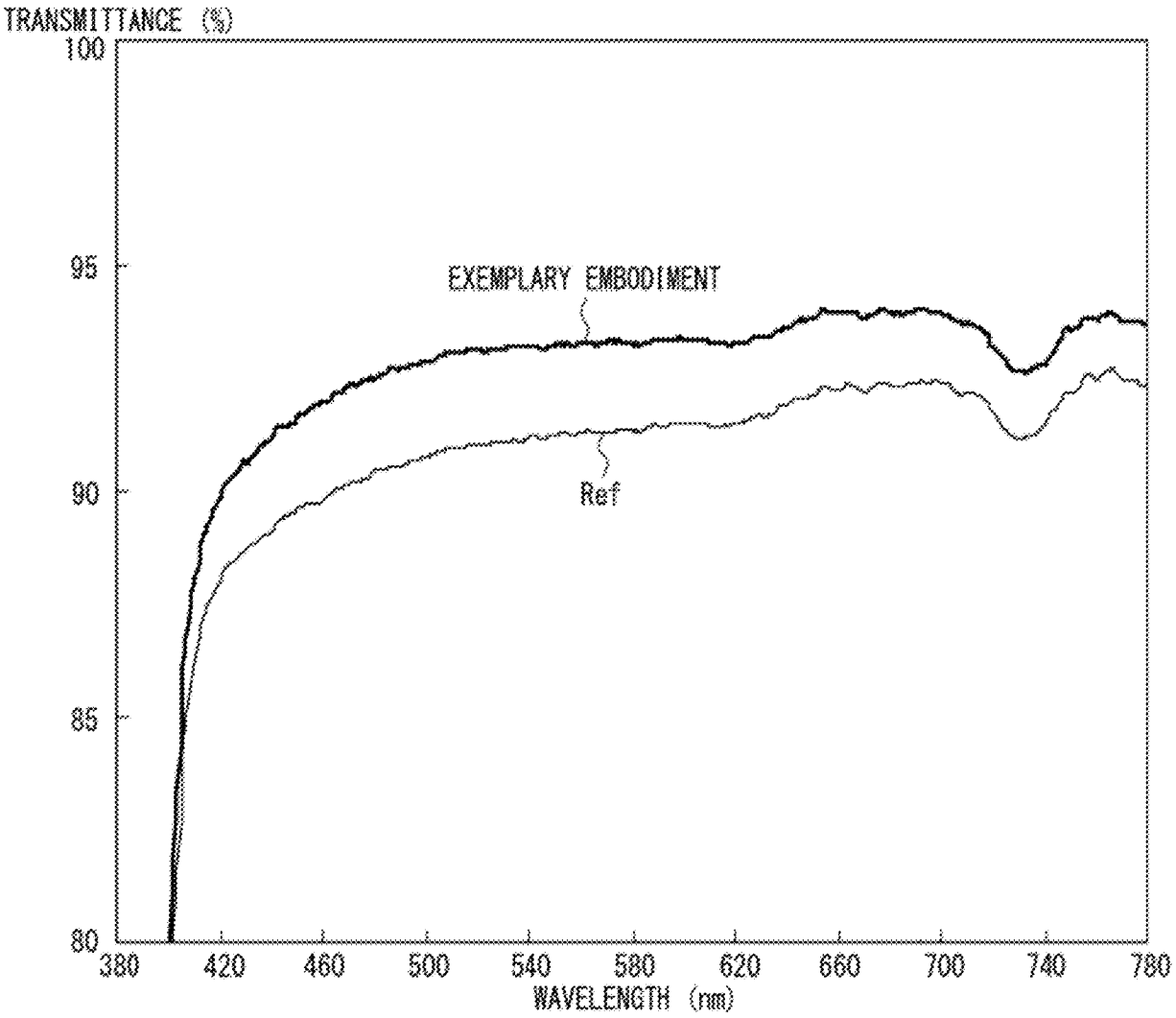
FIG. 6 is a graph showing transmittance characteristics of a projection lens according to an exemplary embodiment.

FIG. 6 is a graph showing transmittance characteristics of the projection lens according to the present exemplary embodiment. In FIG. 6, the vertical axis represents the transmittance (%), and the horizontal axis represents the wavelength (nm). In addition to the transmittance characteristics of the projection lens according to the present exemplary embodiment, FIG. 6 depicts the transmittance characteristics of a projection lens as a comparative example (denoted "Ref" in the graph) where no fine asperity structure is formed. The transmittance of the projection lenses shown in FIG. 4 is measured using the spectrometer.

As evident from FIG. 6, the projection lens according to the present exemplary embodiment achieves a high transmittance over a wide range of visible light wavelengths, as compared with the projection lens of the comparison example.

Figure 7:
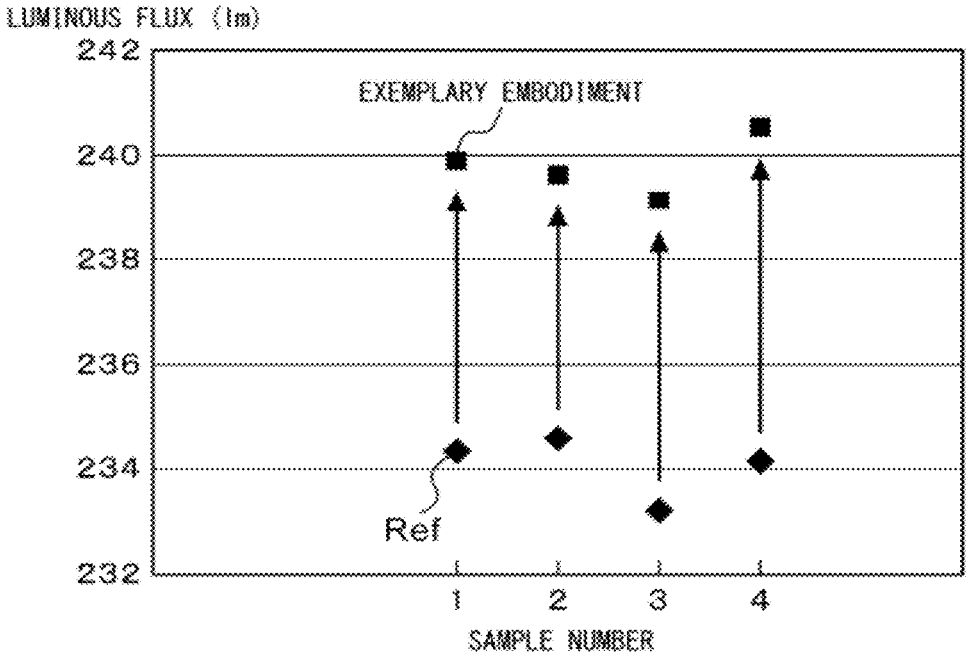
FIG. 7 is a graph showing a comparison between the luminous flux of an automotive lamp according to an exemplary embodiment and that according to a comparative example.

A description is now given of an exemplary embodiment where the projection lens is assembled into an automotive lamp. FIG. 7 is a graph showing a comparison between the luminous flux of an automotive lamp according to the present exemplary embodiment and that according to the comparative example. The comparative example is an automotive lamp where the projection lens having no fine asperity structure formed thereon is incorporated. Here, the luminous flux is measured for four different projection lens samples each having a different injection molding condition.

As evident from FIG. 7, the luminous flux of the automotive lamp according to the comparative example is in a range of about 233 lm to 235 lm, whereas the luminous flux of the automotive lamp according to the present exemplary embodiment is in a range of 239 lm to 241 lm, which are much greater as compared with the respective comparative example samples. This indicates that the fine asperity structure formed on the incident surface is effective in increasing the luminous flux.

As described above, the use of the projection lens where the fine asperity structure is formed enhances the light utilization efficiency. Thereby, an automotive lamp having a higher luminance can be realized.

In the above-described exemplary embodiments, the fine asperity structure 46 is formed on the incident surface 42 of the projection lens 40. In addition to this, a fine asperity structure may be formed on the emission surface 44 of the projection lens 40 as well. Alternatively, the fine asperity structure may be formed on the emission surface 44 only of the projection lens 40. The conditions set by the fine asperity structure formed on the emission surface 44 may be the same as those set by the fine asperity structure formed on the incident surface 42. In these modifications, the reflection on the emission surface 44 is reduced, so that the light utilization efficiency can be further improved.

The present invention has been described based upon illustrative embodiments. These exemplary embodiments are intended to be illustrative only and it will be obvious to those skilled in the art that various modifications to constituting elements and processes could be developed and that such modifications are also within the scope of the present invention.

In the above-described exemplary embodiments, for example, the LED is used as the light source but the light source is not limited to the LED. Also, in the above-described exemplary embodiments, the configuration is such that the light reflected by the reflector is incident on the projection lens. However, this should not be considered as limiting and, for example, the configuration may be such that the light emitted from the light source is led directly to projection lens.

What is claimed is:

1. An automotive lamp comprising:

a light source mounting part configured to mount a light source thereon; and a projection lens having an incident surface, which receives light emitted from the light source, and an emission surface that emits the light toward a front area of the lamp, wherein a fine asperity structure is formed on at least one of the incident surface and the emission surface of the projection lens, and wherein the fine asperity structure includes a plurality of randomly distributed adjacent recesses or raised portions formed such that a pitch between the adjacent recesses or between the adjacent raised portions is less than or equal to a visible light wavelength so as to increase transmitted light emitted from the emission surface by reducing reflected light reflected from the incident surface and/or the emission surface.

2. The automotive lamp according to claim 1, wherein the fine asperity structure is formed on both the incident surface and the emission surface.

3. The automotive lamp according to claim 1, wherein the fine asperity structure includes recesses or raised portions formed such that a pitch between the adjacent recesses or between the adjacent raised portions is in a range of 10 nm to 780 nm.

4. The automotive lamp according to claim 1, wherein the fine asperity structure includes recesses or raised portions whose aspect ratio is 1 or above.

5. The automotive lamp according to claim 1, wherein the light source is an LED.

6. The automotive lamp according to claim 1, wherein the automotive lam further comprises a reflector, which receives the light emitted from the light source and then reflects the light toward the incident surface of the projection lens.

7. The automotive lamp according to claim 1, wherein the projection lens is made of a material including acrylic or polycarbonate.

* * * * *